US007152653B1

(12) United States Patent
Kubly et al.

(10) Patent No.: US 7,152,653 B1
(45) Date of Patent: Dec. 26, 2006

(54) ROLL-UP CURTAIN ASSEMBLY

(76) Inventors: Larry J. Kubly, 606 N. Franklin St., Edgewood, IA (US) 52042; Richard P. Schmelzer, 27068 Jigsaw Rd., Garnavillo, IA (US) 52049

( * ) Notice: Subject to any disclaimer, the term of this patent is extended or adjusted under 35 U.S.C. 154(b) by 262 days.

(21) Appl. No.: 10/821,680

(22) Filed: Apr. 8, 2004

(51) Int. Cl.
*E06B 9/13* (2006.01)

(52) U.S. Cl. ..... 160/120; 160/243; 160/310

(58) Field of Classification Search ..... 160/120, 160/121.1, 122, 241, 243, 310, 311, 1, 7, 160/271, 270
See application file for complete search history.

(56) References Cited

U.S. PATENT DOCUMENTS

| | | | | |
|---|---|---|---|---|
| 1,742,094 | A | 12/1929 | Perks et al. | |
| 2,300,024 | A | 10/1942 | Terrell | |
| 2,564,208 | A | 8/1951 | Michelman | |
| 2,839,135 | A | 6/1958 | Anderson | |
| 3,180,401 | A | 4/1965 | Gambon et al. | |
| 3,211,211 | A | 10/1965 | Youngs | |
| 3,306,344 | A | 2/1967 | Youngs | |
| 3,398,779 | A * | 8/1968 | Kuss | 160/243 |
| 3,460,602 | A | 8/1969 | Hugus | |
| 3,464,480 | A | 9/1969 | Kuss | |
| 4,478,268 | A | 10/1984 | Palmer | |
| 4,987,942 | A * | 1/1991 | Eriksson | 160/243 |
| 5,372,173 | A * | 12/1994 | Horner | 160/98 |
| 5,520,236 | A | 5/1996 | Thomas et al. | |
| 5,524,693 | A * | 6/1996 | Hamilton | 160/243 |
| 5,680,893 | A | 10/1997 | Neer | |
| 5,890,240 | A | 4/1999 | Graham | |
| 6,155,326 | A * | 12/2000 | Imhoff et al. | 160/243 |
| 6,401,794 | B1 * | 6/2002 | Hamilton | 160/243 |
| 6,612,359 | B1 | 9/2003 | Moreau | |
| 6,860,310 | B1 * | 3/2005 | Kubly et al. | 160/122 |
| 6,978,822 | B1 * | 12/2005 | Schoonen | 160/310 |
| 2005/0241779 | A1 * | 11/2005 | Abouloukme | 160/122 |

FOREIGN PATENT DOCUMENTS

| | | |
|---|---|---|
| DE | 2260348 | 6/1974 |

* cited by examiner

*Primary Examiner*—David Purol
(74) *Attorney, Agent, or Firm*—Emrich & Dithmar

(57) ABSTRACT

A multi-section roll-up curtain is raised and lowered by plural support/rotational drive mechanisms disposed in a spaced manner along the length of the curtain. Each drive mechanism is symmetrically loaded with a curtain section attached to opposed sides of each drive mechanism. Each curtain section includes plural vertically spaced curtains which are simultaneously rolled-up and unrolled. Each drive mechanism includes plural vertically spaced drive motors each connected to first and second curtain-bearing roll-up tubes disposed on opposite sides of a drive motor. A generally vertical guide member is coupled to each drive motor by a respective carriage assembly allowing the drive motors to travel up in rolling up the curtains and down in unrolling the curtains. This arrangement accommodates the large torques encountered in operating long curtain sections permitting multi-section curtains 600' and longer in length to be reliably and safely operated without using large, powerful motors.

51 Claims, 4 Drawing Sheets

ROLL-UP CURTAIN ASSEMBLY

FIELD OF THE INVENTION

This invention relates generally to multi-section roll-up curtains, where each section includes plural vertically aligned curtains which are simultaneously rolled-up and unrolled, and is particularly directed to very long, multi-section curtains and a curtain support/rotational drive arrangement capable of accommodating the large torques encountered in these types of curtains.

BACKGROUND OF THE INVENTION

A common type of flexible door employs a drive mechanism for raising and lowering the door and includes an electrically powered motor which applies torque to a roller causing the door to wind up on or to unwind from the roller in positioning the door in either the open or closed position, or any position therebetween. A common type of flexible curtain is comprised of a lightweight, strong fabric material and includes an electric motor typically connected to a roller mechanism via a reduction gear to reduce the number of revolutions of the electric motor per unit distance of travel of the flexible door in raising and lowering the door. Movable structures of this type can be used either to cover an opening, such as a doorway in a building structure, or they may be used as a movable partition, wall or curtain in the structure.

When used as a partition, or curtain, this roll-up structure may span large distances in the building structure. These types of flexible curtains isolate the inside of the building structure from the elements, such as wind, rain, snow and sunlight, while permitting the building structure to be opened up so as to provide access to the outside when the environment is more hospitable.

As the applications for these types of flexible curtains have increased, additional demands have been placed on their structure and operation. For example, these types of flexible curtains are being used to span increasingly longer distances within the building structure. This, of course, places increasing demands upon the curtain support and drive, or displacement, system. Higher power ratings are required for the curtain drive mechanism, which typically includes an electrically powered motor, for increasing heights and horizontal distances spanned by the curtain. In addition, the curtain support system, which typically includes a horizontal, elongated rod, must be stronger to accommodate the increased weight of curtains spanning larger openings and must itself be lightweight to compensate for the increased weight of the curtain. This further increases the power requirements to operate the flexible curtain. In addition, the increased weight of the curtain with longer curtain lengths gives rise to the application of large torques arising from the unwinding forces exerted by the long length of the rolled-up curtain on the curtain support/drive mechanism. This increased torque places increased stress on the curtain support structure and drive mechanism. Where a roll-up rod is attached to a lower end of the flexible curtain, a complicated displacement and support mechanism is typically required to accommodate vertical movement of the rod during curtain roll-up and unrolling.

These types of curtains are increasingly being used in dairy barns wherein large numbers of cows are maintained and housed. Roll-up curtains are particularly adapted for this type of environment because they allow for easy and quick control of air flow as well as access to the outside environment. Sufficient ventilation is important in this environment to allow warm moisture to escape, to protect the cows from drafts and cold winter air, and to keep the cows dry. The increase in the size of herds has increased the demand for larger buildings offering improved ventilation and environmental isolation characteristics. This has necessitated the adoption of curtains of longer length with corresponding increased demands on the curtain support structure and drive mechanism.

The present invention addresses the aforementioned increased demands on roll-up curtains used in various applications by providing a curtain support and drive arrangement which accommodates the increased weights of longer curtain sections forming the walls of larger structures. The curtain support and drive arrangements used in the present invention are particularly designed to accommodate the large torques encountered when operating roll-up curtains of increased length.

OBJECTS AND SUMMARY OF THE INVENTION

Accordingly, it is an object of the present invention to provide a multi-section roll-up curtain incorporating plural drive mechanisms arranged in a spaced manner along the length of the curtain to accommodate curtains spanning very long distances, i.e., as long as 600' in length.

Another object of the present invention to incorporate a counter force in the rotary drive mechanism of a roll-up curtain to accommodate the large torque exerted by very long length and/or very large height curtains on the curtain support/rotary drive mechanism.

Still another object of the present invention is to reduce the mechanical stress on and prolong the operating lifetime of a rotary drive mechanism used in raising and lowering a roll-up curtain by applying the force of the curtain's weight symmetrically to the curtain support/rotary drive mechanism.

It is another object of the present invention is to provide a drive arrangement for a roll-up curtain which is easily installed, highly reliable, comprised of a small number of easily assembled components, and capable of accommodating the weight of large curtains.

This invention contemplates a roll-up curtain comprising: a first curtain section including a first fixed upper rod attached to a support structure and a second lower rod; a second curtain section including a third fixed upper rod attached to the support structure and a fourth lower rod, wherein the second curtain section is aligned with and laterally spaced from the first curtain section; a rotary drive disposed intermediate the first and second curtain sections and coupled to the second and fourth lower rods for rotationally displacing the second and fourth lower rods in a first direction for rolling up the first curtain section on the second lower rod and the second curtain section on the fourth lower rod in opening the first and second curtain sections, and for rotationally displacing the second and fourth lower rods in a second opposed direction for unrolling the first curtain section from the second lower rod and the second curtain section from the fourth lower rod in closing the first and second curtain sections; and a vertical guide engaging the rotary drive for directing the rotary drive in vertical travel upward during rolling up of the curtain sections and downward during unrolling of the curtain sections and maintaining the rotary drive a fixed distance from and in a fixed orientation relative to the first and second curtain sections during rolling up and unrolling of the curtain sections.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
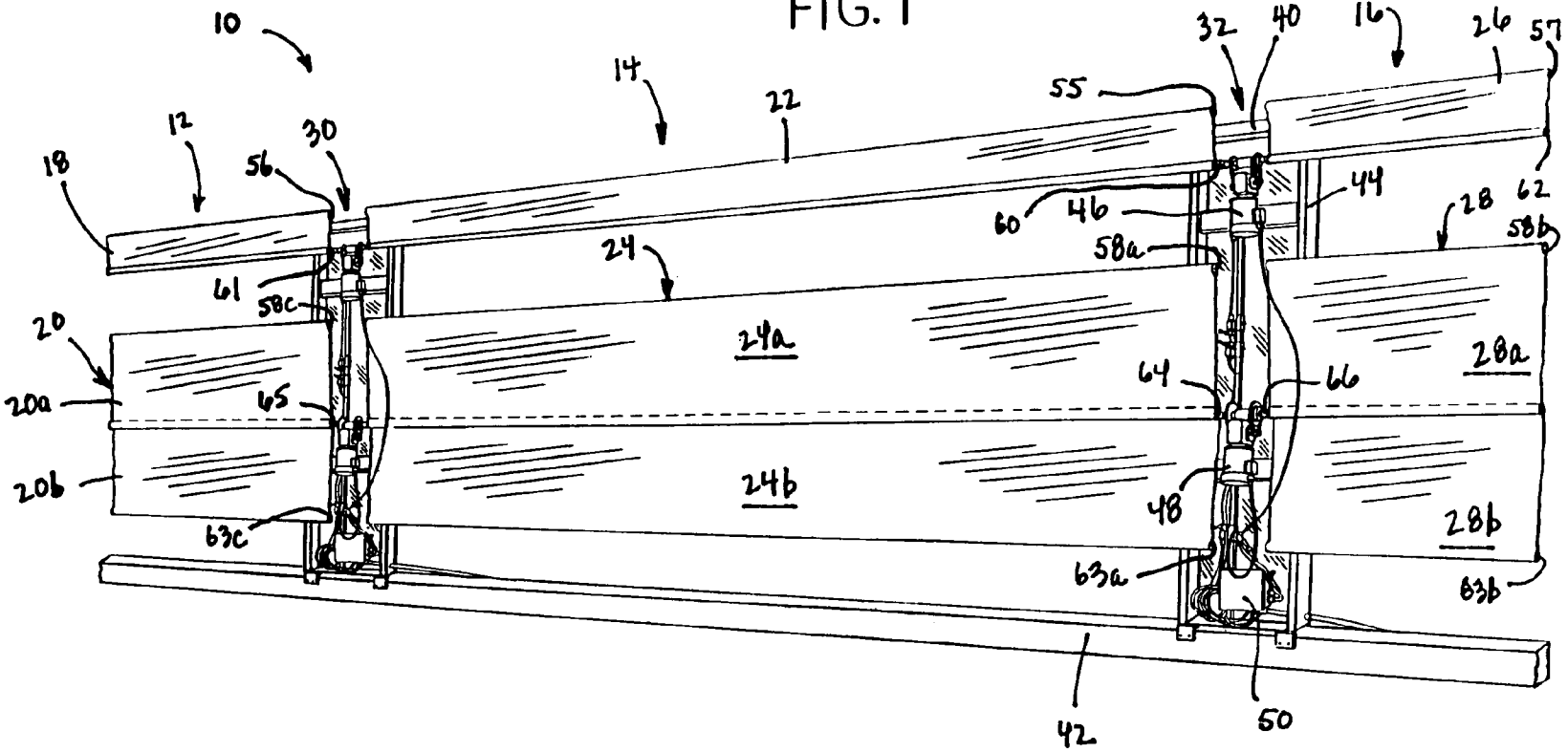
FIG. 1 is a perspective view of a multi-section roll-up curtain assembly in accordance with the principles of the present invention.

Referring to FIG. 1, there is shown a perspective view of multi-section roll-up curtain assembly 10 in accordance with the present invention. Roll-up curtain assembly 10 includes first, second and third curtain sections 12, 14 and 16 disposed in a laterally spaced array over an opening in a building structure. Each of the first, second and third curtain sections 12, 14 and 16 includes an upper curtain and a lower curtain capable of being moved between a rolled-up position, wherein the curtain is opened, and an unrolled position, wherein the curtain sections fully cover the opening in the building structure. Thus, the first curtain section 12 includes an upper curtain 18 and a lower curtain 20. The second curtain section 14 includes upper curtain 22 and lower curtain 24. Finally, the third curtain section 16 includes upper curtain 26 and lower curtain 28. The lower curtain 20 of the first curtain section 12 includes an upper portion 20*a* and lower portion 20*b*. Similarly, the lower curtain 24 of the second curtain section 14 includes upper portion 24*a* and lower portion 24*b*. Finally, lower curtain 28 includes an upper portion 28*a* and a lower portion 28*b*.

The opening in the building structure over which the roll-up curtain assembly 10 is positioned is defined by an upper support member 40, a lower support member 42, and a pair of lateral limits to the opening which are not shown in FIG. 1 for simplicity. The upper and lower support members 40, 42 are connected to and integral with the building structure, which also is not shown in the figure for simplicity.

Disposed within each of the aforementioned curtain sections are plural hems which extend the length of the curtain section and which are each adapted to receive a respective elongated, linear, tubular rod extending the length of the curtain section. Thus, upper curtain section 22 includes upper and lower hems respectively adapted to receive an upper support rod 55 and a lower drive rod 60. Similarly, upper curtain section 26 includes upper and lower hems which are adapted to receive an upper support rod 57 and a lower drive rod 62, respectively. Finally, upper curtain section 18 includes upper and lower hems which are adapted to receive an upper support rod 56 and a lower drive rod 61, respectively. Each of the aforementioned upper support rods is securely attached to the upper support member 40, or another structural member within the building structure, by means of a conventional connecting bracket which is not shown in the figure for simplicity.

Similarly, lower curtain 24 is provided with plural spaced hems which are adapted to receive an upper support rod 58*a*, an intermediate drive rod 64 and a lower rod 63*a*. Lower curtain 28 is adapted to receive an upper support rod 58*b*, an intermediate or drive rod 66 and a lower rod 63*b*. Finally, lower curtain 20 is adapted to receive an upper support rod 58*c*, an intermediate drive rod 65 and a lower rod 63*c*. Each of the aforementioned upper support rods 58*a*, 58*b* and 58*c* of the lower curtains is securely attached to the building structure by conventional means such as mounting brackets which are not shown in the figure for simplicity. It is in this manner that each of the lower curtains is supported by and suspending from the building structure. The weight of each of the lower rods 63*a*, 63*b* and 63*c* maintains each of the lower curtains in a stretched condition when suspended from a respective upper support rod. Each of the rods disposed in each of the lower curtains extends the full length of the lower curtain. Each of the aforementioned rods is preferably comprised of a high strength, lightweight, rigid material such as structural steel or aluminum.

Disposed between and connected to each adjacent pair of upper and lower curtains is a respective curtain support/drive mechanism. Thus, a first curtain support/drive mechanism 30 is disposed between and connected to upper curtains 18 and 22 and lower curtains 20 and 24 of the first and second curtain sections 12, 14. Similarly, a second curtain support/drive mechanism 32 is disposed between and coupled to upper curtains 22 and 26 and lower curtains 24 and 28 of the second and third curtain sections 14, 16. A similar curtain support/drive mechanism is connected to the outer end of each of the end curtain sections in a manner similar to that shown in FIG. 1 and described below, although this is not shown in FIG. 1 for simplicity. Although FIG. 1 shows three curtain sections driven by two or more curtain support/drive mechanisms, a preferred embodiment of the present invention includes first and second curtain sections driven by an inner curtain support/drive mechanism located between the two curtain sections and by two outer curtain support/drive mechanisms each located on an outer end of one of the curtain sections. Individual curtain sections several hundred feet in length may be raised and lowered in this preferred embodiment to cover openings of 600' and longer in length.

Figure 2:
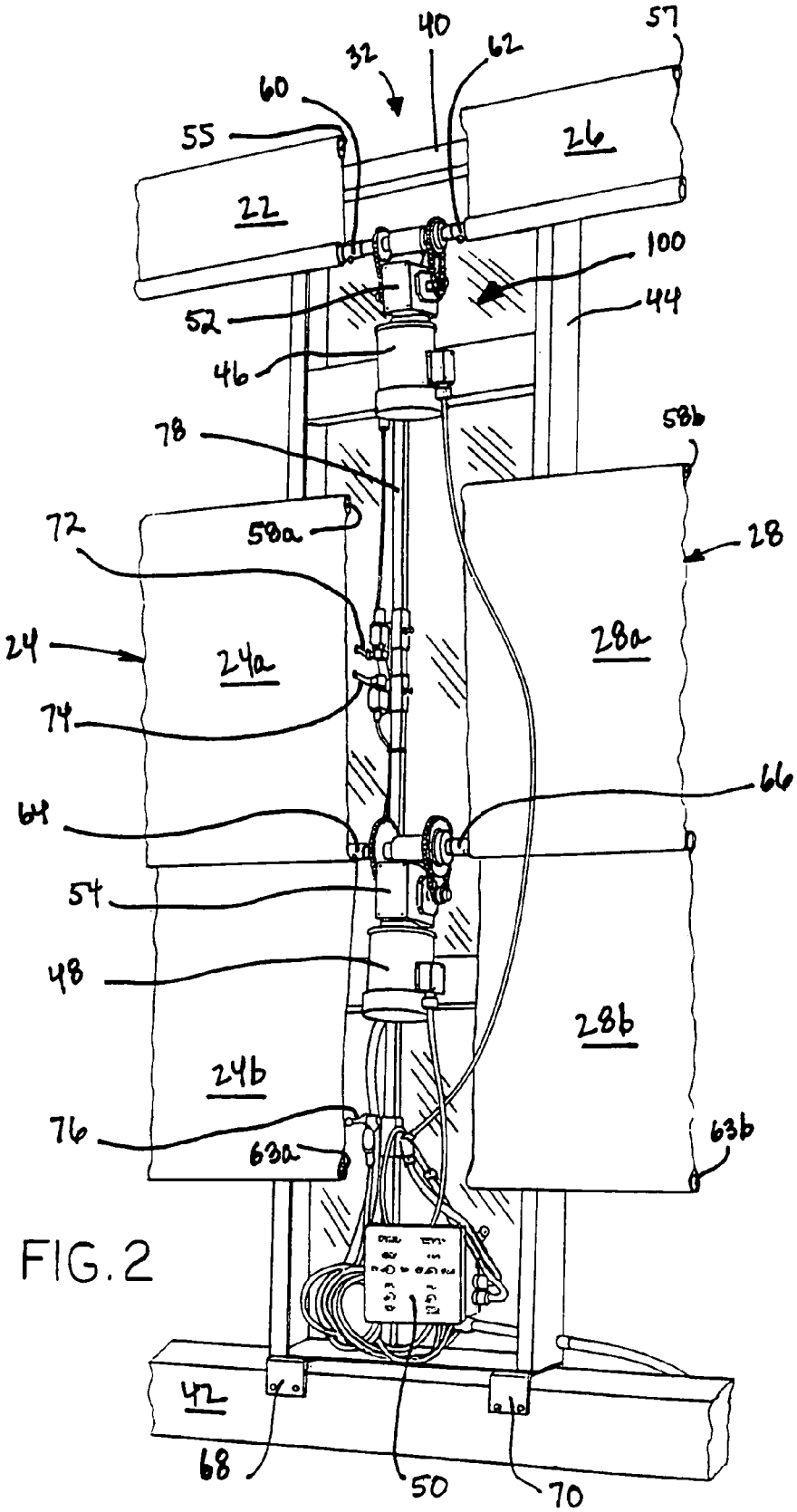
FIG. 2 is a perspective view of a curtain support/drive mechanism for raising and lowering plural curtain sections in the roll-up curtain assembly of the present invention.
Figure 3:
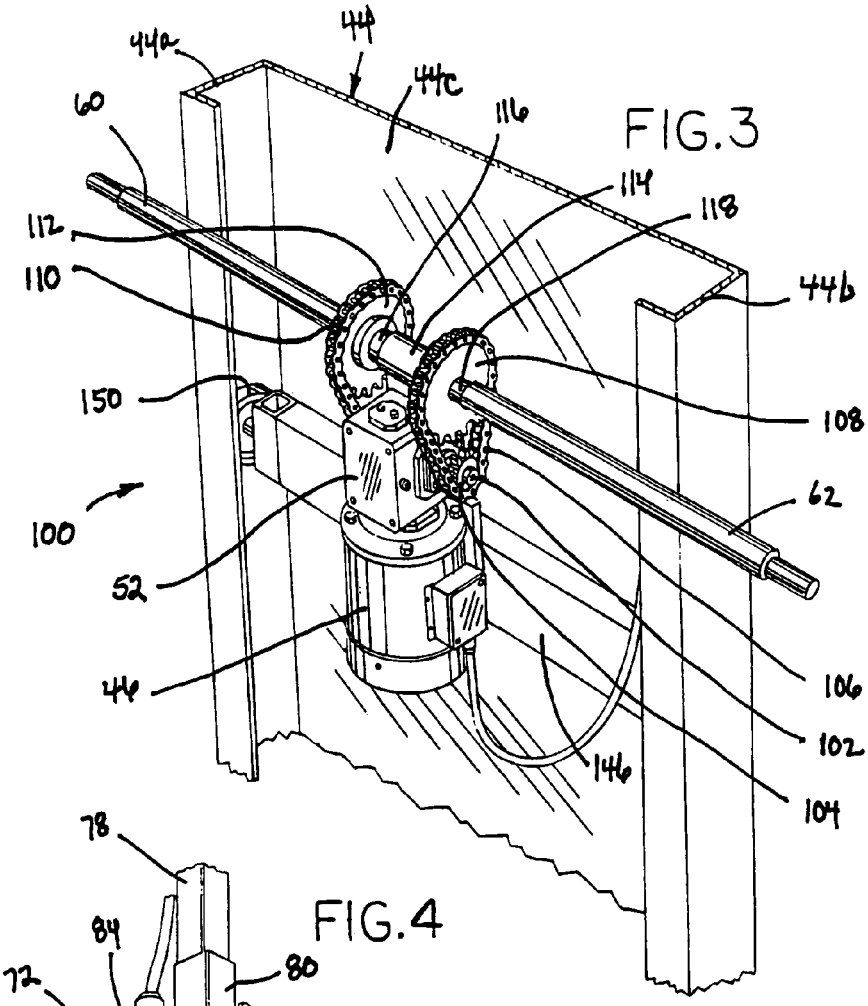
FIG. 3 is an upper perspective view of a curtain rotary drive and displacement assembly used in the roll-up curtain of the present invention.
Figure 6:
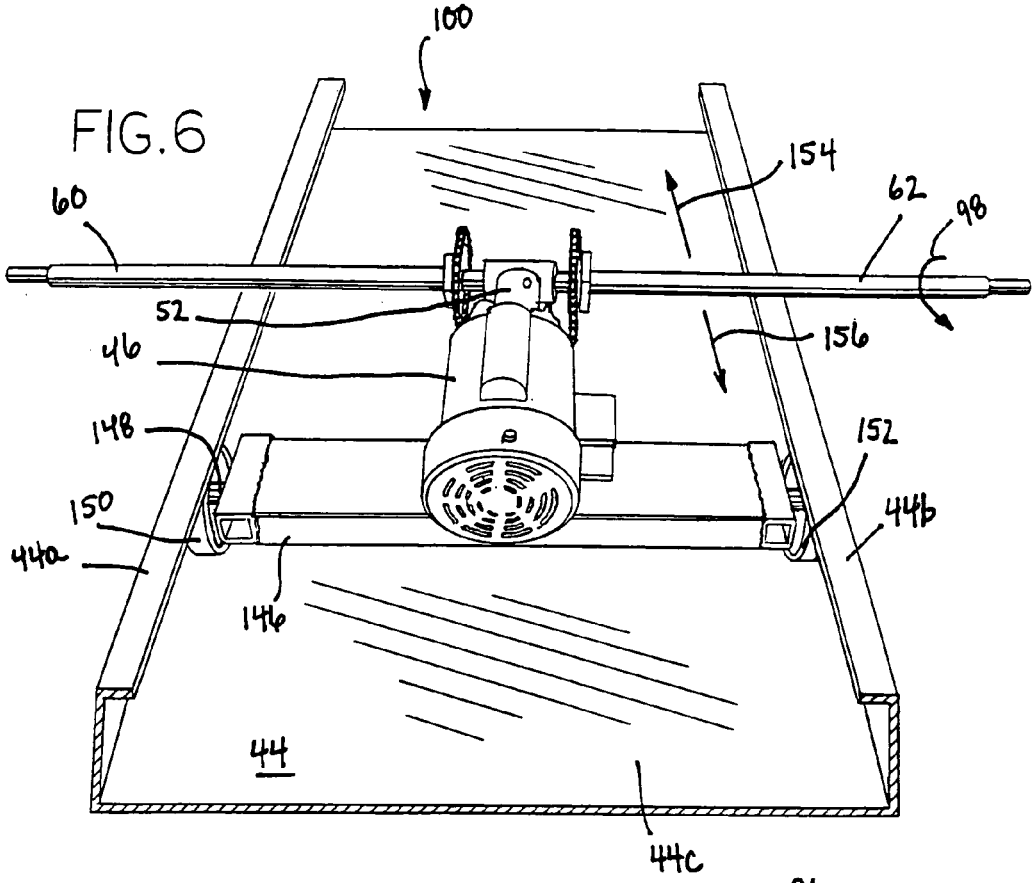
FIG. 6 is a lower perspective view of the curtain drive and displacement assembly shown in FIG. 3.
Figure 7:
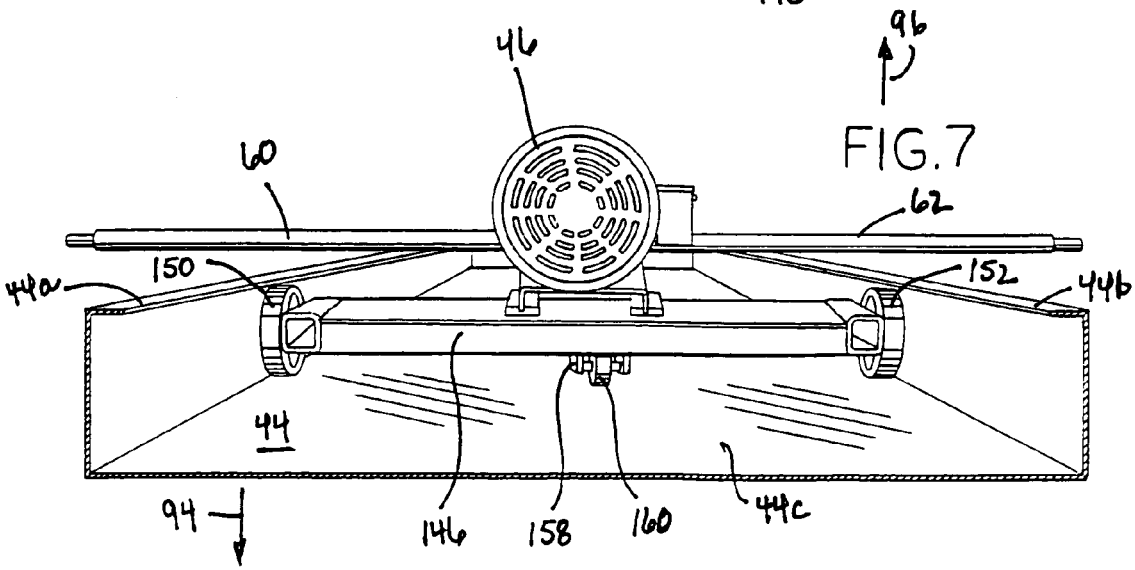
FIG. 7 is a bottom view of the curtain drive assembly shown in FIG. 3.

The second curtain support/drive mechanism 32 is shown in greater detail in the front perspective view of FIG. 2. Curtain support/drive mechanism 32 includes a generally vertically oriented guide member 44 connected near its upper end to the upper support member 40 by conventional connecting brackets which are not shown in the figure for simplicity. Similarly, the lower end of vertical guide member 44 is securely attached to the lower support member 42 by means of connecting brackets 68 and 70. FIG. 3 is a perspective view illustrating additional details of an upper drive assembly 100 attached to the vertical guide member 44. FIGS. 6 and 7 are lower perspective views showing additional details of the manner in which the upper drive assembly 100 is attached to and is displaced along the vertical guide member 44.

Each of the curtain support/drive mechanisms includes an upper drive assembly and a lower drive assembly. The upper drive assembly includes an upper electrical drive motor 46, while the lower drive assembly includes a lower electrical drive motor 48. The upper drive assembly 100 further includes a first gearbox 52 connected to the upper electric drive motor 46, while the lower drive assembly includes a second gearbox 54 connected to the lower electric drive motor 48. The combination of the lower electrical drive motor 48 and the second gearbox 54 is coupled to the intermediate drive rods 64 and 66 of the lower curtains 24 and 28 by suitably connecting hardware which will now be described in detail in terms of the upper drive assembly 100 shown in FIG. 4 because the construction and operation of the upper and lower drive assemblies is identical.

Connected to the first gearbox 52 and rotationally driven by the upper electric drive motor 46 is a drive shaft 102. Attached to respective ends of the drive shaft 102 are a first drive sprocket 104 and a second drive sprocket, which is not shown in FIG. 4 for simplicity. Disposed about the first drive sprocket 104 is a first endless chain 106, while disposed about the second drive sprocket is a second endless chain 110. Respectively disposed above and adjacent to the first drive sprocket 104 and the second drive sprocket are first and second driven sprockets 108 and 112. Endless chains 106 and 110 also respectively engage the first and second driven sprockets 108 and 112. Thus, rotation of the drive shaft 102 produces a corresponding rotation of the first drive sprocket 104 and the second drive sprocket giving rise to a corresponding rotation of the first and second driven sprockets 108 and 112. The first and second driven sprockets 108, 112 are securely coupled together by means of the combination of a spacer tube 114 and first and second brass bushings 116 and 118. Thus, the first and second driven sprockets 108 and 112 undergo the same rotational displacement. The first brass bushing 116 is securely connected to lower drive rod 60 of the upper curtain 22 of the second curtain section 14 as shown in FIG. 2. Similarly, the second brass bushing 118 is securely connected to the lower drive rod 62 of the upper curtain 26 of the third curtain section 16 as also shown in FIG. 2. Thus, the upper drive assembly 100 simultaneously rotationally displaces lower drive rods 60 and 62 in a first direction for rolling up the upper curtains and raising the two curtain sections, or in a second, opposed direction for unrolling the two upper curtains in unrolling the two adjacent curtain sections. A similar arrangement allows the lower drive assembly which includes a combination of lower electric drive motor 48 and second gearbox 54 to either roll-up the adjacent lower curtains 24 and 28 respectively onto intermediate drive rods 64 and 66, or to unroll these curtains from the two intermediate drive rods in lowering the curtain sections. It should be noted that each of the upper and lower portions 24*a* and 24*b* of lower curtain 24 and each of the upper and lower portions 28*a* and 28*b* of lower curtain 28 are simultaneously rolled onto or unrolled from the lower drive rods 64 and 66, respectively, during operation of the lower electric drive motor 48.

While each of the lower curtains has been described and is illustrated as including an upper support rod, an intermediate drive rod and a lower rod, the present invention will work equally as well if the intermediate rod is omitted and the curtain is raised and lowered by means of its lower rod. Thus, for example, the present invention contemplates eliminating the intermediate drive rods 64, 65 and 66 of lower curtains 24, 20 and 28 and driving, i.e., raising and lowering, these curtains by means of a drive assembly connected to the lower rods 63*a*, 63*b* and 63*c* of these lower curtains. The advantage of the arrangement shown in FIG. 2 where the drive arrangement is connected to an intermediate drive rod is that the upper and lower portions of each of these curtains are simultaneously rolled up on or unrolled from the rotating drive rod which reduces the time and the number of revolutions to roll-up or unroll the curtain.

As shown in the various figures, each drive assembly includes a carriage 146 connected to a drive motor as shown for the case of the upper electric drive motor 46 of the upper drive assembly 100. A similar carriage arrangement is connected to the lower electric drive motor 48 and operates in a similar manner to allow the drive assembly to move upward and downward within the vertical guide member 44 as described in the following paragraphs.

Carriage 146 is in the form of a linear, elongated shaft of a high strength material such as structural steel and includes an inner shaft, or axle, 148 which extends the length of the carriage. Attached to a first end of shaft 148 is a first roller 150, while attached to a second, opposed end of the shaft is a second roller 152. Vertical guide member 44 includes a generally flat inner portion 44*c* and first and second edge flanges 44*a* and 44*b* disposed on opposed lateral edges thereof. Each of the edge flanges 44*a*, 44*b* extends outwardly from the flat inner portion 44*c* of the vertical guide member 44 and forms a channel which is adapted to receive and engage a respective roller of the carriage 146. Thus, the first edge flange 44*a* is adapted to receive and engage the first roller 150, while the second edge flange 44*b* is adapted to receive and engage the second roller 152. Each of the rollers 150, 152 freely rotates on the carriage's shaft 148 and allows the carriage 146 to move vertically along the length of the vertical guide member 44. Thus, as the lower drive rods 60 and 62 are rotationally displaced by the upper electric motor 46 of the upper drive assembly 100, the combination of the upper electric motor and first gearbox 152 and associated hardware attached to the carriage 146 is free to move vertically up in the direction of arrow 154 and down in the direction of arrow 156 in FIG. 6 along and within the vertical guide member 44. This permits adjacent curtains to be rolled-up onto or unrolled from the two drive rods.

The larger weights of longer curtains apply increasingly larger torques to the curtain support and drive mechanism, particularly during raising of the curtain. Thus, if as shown in FIG. 6, lower drive rod 62 rotates in the direction of arrow 92, the weight of the raised, or partially upraised, curtain will exert a torque counter to the direction of arrow 92. The torque exerted by the curtain will urge the first roller 150 in a downward direction as shown by direction arrow 94 in FIG. 7 and will urge the second roller 152 in an upward direction as shown by direction arrow 96 in the figure. The vertical guide member 44 opposes any displacement of the rollers out of the plane of the vertical guide member and ensures that the carriage 146 and the upper electric drive motor 46 attached thereto move only vertically during rolling up and unrolling of the attached curtains. In addition, the torque exerted along the lower drive rod 62 in the direction of arrow 98 shown in FIG. 6 urges the carriage 46 and the upper electric drive motor 46 in a direction toward the vertical guide member 44. In order to accommodate this latter torque, a third roller 160 shown in FIG. 7 is attached to the carriage 146 by means of mounting bracket 158. This third roller 160 facilitates displacement of the carriage 146 and upper electric drive motor 46 combination along the length of vertical guide member 44. Third roller 160 thus counters the tendency of the aligned lower drive rods 60 and 62 to be rotationally displaced by the weight of the attached curtains and opposes any bending of carriage 146 and movement of the upper electric drive motor 46 toward the flat inner portion 44*c* of the vertical guide member 44.

Figure 4:
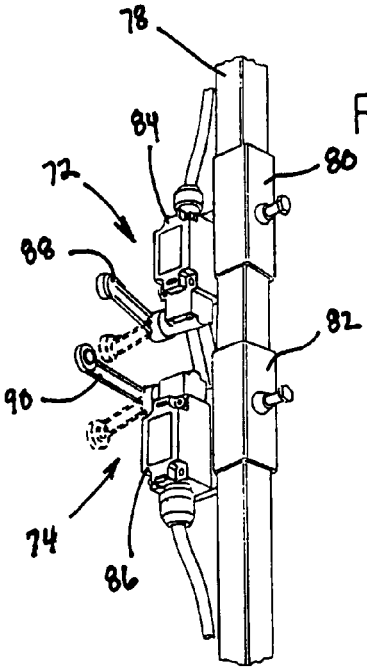
FIG. 4 is a partial perspective view showing a sensor arrangement for limiting the upward and downward movement of a curtain section in accordance with one aspect of the present invention.

Referring to FIG. 4, there is shown a perspective view of the combination of first and second limit switches 72 and 74. The first limit switch 72 is attached to a vertical pipe, or tube, 78 by means of a first coupling bracket 80. Similarly, the second limit switch 74 is attached to the vertical pipe 78 by means of a second coupling bracket 82. The vertical pipe 78 is disposed within and attached to the vertical guide member 44 by conventional means such as connecting brackets which are not shown for simplicity. The first limit switch 72 includes a first pivot arm 88 coupled to a first sensor housing 84. Similarly, the second limit switch 74 includes a second pivot arm coupled to a second sensor housing 86. Each of the first and second pivot arms 88, 90 is free to pivot upward or downward about its associated sensor housing. Thus, the first limit switch 72 provides an indication that the upper curtains 22 and 26 are in the full "DOWN" position. Another limit switch (not shown in the figures for simplicity) located in an upper portion of the roll-up curtain assembly provides an indication of the full "UP" position of the two upper curtains 22, 26. The second limit switch 74 provides an indication of the full "UP" position of the two lower curtains 24, 28. A third limit switch 76 mounted to a lower portion of the vertical pipe 78 as shown in FIG. 2 provides an indication that the lower curtains 24 and 28 are in the full "DOWN" position. In the embodiment shown in the figures, the third limit switch 76 is engaged by the lower rod 63*a* of the second curtain section's lower curtain 24. In the embodiment of the present invention where the lower curtain does not include upper and lower portions with the curtain's drive rod disposed on its lower edge, the third limit switch 76 would be engaged by the lower curtain's drive rod located on its lower edge.

Figure 5:
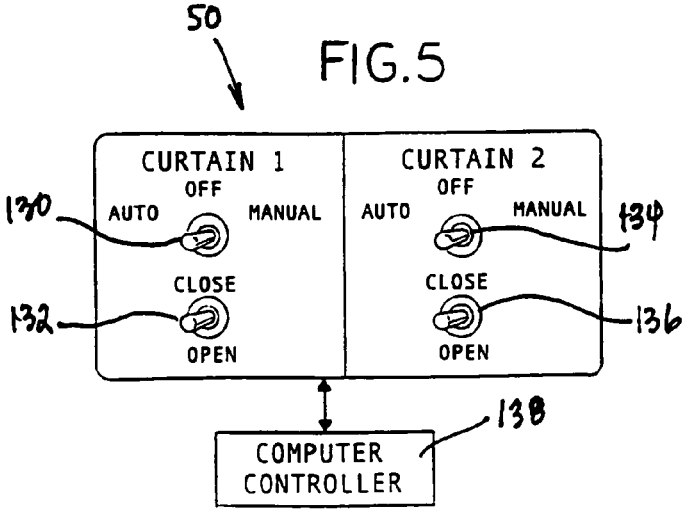
FIG. 5 is a simplified combined block and schematic diagram of a control system for use in controlling the roll-up curtain assembly of the present invention.

Referring to FIG. 5, there is shown a combined schematic and block diagram of a control panel 50 coupled to a computer controller 138 for controlling the operation of the roll-up curtain assembly of the present invention. The left portion of the control panel 28 provides control of the first curtain section 12 shown in FIG. 1, while the right portion of the control panel controls the operation of the second curtain section 14. A third portion of the control panel 50 provides control for the third curtain section 16 shown in FIG. 1, but this is not shown in FIG. 5 for simplicity. Control panel 50 includes first and second toggle switches 130 and 132. The first toggle switch 130 allows the user to select either an automatic or manual mode of operation, or to turn the controller for the first curtain section 12 "OFF". When in the "AUTOMATIC" mode of operation, the operation of the first curtain section is under the control of the computer controller 138 which stores a pre-programmed operating program. The second toggle switch 132 is operable when the first toggle switch 130 is in the "MANUAL" mode of operation and allows for closing and opening of the first curtain section under the control of an operator. The right portion of the control panel 50 which controls operation of the second curtain section 14 similarly includes a first toggle switch 134 and a second toggle switch 136. The first toggle switch 134 allows for the user to select between "AUTOMATIC" or "MANUAL" operation of the second curtain section, or to turn the curtain controller "OFF". The second toggle switch 136 allows for manually controlling the position of the first curtain section 12 when the first toggle switch is in the "MANUAL" mode of operation.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A roll-up curtain comprising:

a first curtain section including a first fixed upper rod attached to a support structure and a second lower rod;

a second curtain section including a third fixed upper rod attached to the support structure and a fourth lower rod, wherein said second curtain section is aligned with and laterally spaced from said first curtain section;

a rotary drive including an electric motor disposed intermediate said first and second curtain sections and coupled to adjacent ends of said second and fourth lower rods for rotationally displacing said second and fourth lower rods in a first direction for rolling up said first curtain section on said second lower rod and said second curtain section on said fourth lower rod in opening said first and second curtain sections, and for rotationally displacing said second and fourth lower rods in a second opposed direction for unrolling said first curtain section from said second lower rod and said second curtain section from said fourth lower rod in closing said first and second curtain sections; and a vertical guide engaging said rotary drive for directing said rotary drive in vertical travel upward during rolling up of said curtain sections and downward during unrolling of said curtain sections and maintaining said rotary drive a fixed distance from and in a fixed orientation relative to said first and second curtain sections during rolling up and unrolling of said curtain sections.

2. The roll-up curtain of claim 1 wherein said vertical guide includes a generally vertical panel disposed adjacent said rotary drive and a carriage member coupled to and movable with said rotary drive and engaging said vertical panel during vertical travel of said rotary drive.

3. The roll-up curtain of claim 2 wherein said vertical panel is generally flat and includes first and second opposed lateral edges each including a respective retaining flange, wherein said retaining flanges engage, prevent twisting and limit travel of said carriage member in a generally vertical direction.

4. The roll-up curtain of claim 3 wherein said retaining flanges are disposed along the length of said panel and are generally L-shaped in cross section and extend inwardly toward a flat inner portion of said panel.

5. The roll-up curtain of claim 4 wherein said carriage member is generally flat and elongated and is aligned with the flat inner portion of said panel.

6. The roll-up curtain of claim 5 wherein said carriage member includes first and second rollers each disposed on respective opposed ends of said carriage member, and wherein each of said rollers is disposed in and engaged by a respective retaining flange of said panel.

7. The roll-up curtain of claim 6 further comprising at least one elongated, linear shaft for rotationally mounting said rollers to said carriage member.

8. The roll-up curtain of claim 7 wherein the flat inner portion of said panel and said carriage member are aligned generally parallel with said second and fourth lower rods.

9. The roll-up curtain of claim 6 further comprising a third roller attached to said carriage member intermediate the first and second ends thereof and engaging the flat inner portion of said panel for facilitating displacement of the rotary drive on said panel.

10. The roll-up curtain of claim 9 wherein each of said rods is comprised of tubular steel.

11. The roll-up curtain of claim 1 further comprising plural connecting pins inserted through each of the lower portions of said first and second curtain sections and into said second and fourth lower rods.

12. The roll-up curtain of claim 11 wherein each of said connecting pins is a screw or nail.

13. The roll-up curtain of claim 1 wherein said second and fourth lower rods are disposed in lower edge portions of said first and second curtain sections, respectively.

14. The roll-up curtain of claim 13 further comprising a protective sleeve attached to the lower edge of said second curtain section.

15. The roll-up curtain of claim 14 wherein said protective sleeve is comprised of plastic or metal.

16. The roll-up curtain of claim 14 wherein said protective sleeve is comprised of PVC.

17. The roll-up curtain of claim 1 wherein said second curtain section includes an upper portion and a lower portion and wherein said fourth lower rod is disposed on an intermediate portion of said second curtain section between said upper and lower portions, and wherein said upper and power portions of said second curtain section are simultaneously rolled up on or unrolled from said fourth lower rod as said second curtain section is opened or closed.

18. The roll-up curtain of claim 17 further comprising a fifth rod disposed on a lower edge of said second curtain section.

19. The roll-up curtain of claim 18 wherein each of said first and second curtain sections includes plural spaced hems, and wherein each of said rods is disposed within a respective one of said hems of a curtain section.

20. The roll-up curtain of claim 19 wherein each of said rods and hems extends the length of the curtain section within which the rod and hem combination is disposed.

21. The roll-up curtain of claim 20 further comprising plural connecting pins inserted through each of the lower portions of said first and second curtain sections and into said second and fourth lower rods.

22. The roll-up curtain of claim 21 wherein each of said connecting pins is a screw or nail.

23. The roll-up curtain of claim 1 wherein said rotary drive includes a first upper rotary drive coupled to said second lower rod and a second lower rotary drive coupled to said fourth lower rod, and wherein each of said upper and lower rotary drives engages said vertical guide.

24. The roll-up curtain of claim 23 wherein said first upper and second lower rotary drives are further coupled to third and fourth curtain sections, respectively, for rolling up and unrolling said third and fourth curtain sections simultaneously with said first and second curtain sections, and wherein said first and third curtain sections are disposed on opposed sides of said first upper rotary drive and said second and fourth curtain sections are disposed on opposed sides of said second lower rotary drive.

25. The roll-up curtain of claim 24 wherein said first and second rotary drives respectively include first and second electric motors.

26. The roll-up curtain of claim 25 wherein said first and second rotary drives further respectively include first and second gearboxes coupled to said first and second electric motors, respectively.

27. The roll-up curtain of claim 26 further comprising first and second double reduction drive assemblies respectively coupling said first and second gearboxes to said second and fourth lower rods.

28. The roll-up curtain of claim 27 wherein each of said first and second double reduction drive assemblies includes a respective drive sprocket coupled to a gearbox, a respective driven sprocket coupled to a lower rod, and a respectively roller chain connecting paired drive and driven sprockets.

29. The roll-up curtain of claim 1 further comprising a first pair of detectors for sensing a full-up position and a full-down position of said first curtain section and a second pair of detectors for sensing a full-up position and a full-down position of said second curtain section for limiting vertical displacement of said first and second curtain sections.

30. The roll-up curtain of claim 29 wherein said first pair of detectors includes first upper and lower limit switches engaged by said second lower rod and said second pair of detectors includes second upper and lower limit switches engaged by said fourth lower rod.

31. A roll-up curtain comprising:

a first curtain section including a first fixed upper rod and a second lower rod;

a second curtain section in vertical alignment with said first curtain section and including a third fixed upper rod and a fourth lower rod, wherein said second curtain section is disposed below said first curtain section;

first and second rotary drives respectively including first and second electric motors respectively coupled to a first end of said second lower rod and a first end of said fourth lower rod, wherein said first and second curtain sections are rolled up on said second and fourth lower rods, respectively, when said rods are rotated in a first direction by said rotary drives and said rods move upward, and wherein said first and second curtain sections are unrolled from said lower rods when said rods are rotated in a second, opposed direction by said rotary drives and said rods move downward;

first and second carriages respectively coupled to said first and second rotary drives for moving upward and downward with said rotary drive; and a fixed, generally vertical guide engaging said first and second carriages in a movable manner for limiting movement of said first and second rotary drives to vertical direction and preventing a torque exerted by said curtain sections on said lower rods from changing the position or orientation of said rotary drives.

32. The roll-up curtain of claim 31 wherein said second curtain section includes an upper portion and a lower portion, and wherein said fourth lower rod is disposed intermediate said upper and lower portions.

33. The roll-up curtain of claim 32 further comprising a fifth rod disposed on a lower edge of said lower portion of said second curtain section.

34. The roll-up curtain of claim 31 wherein each of said first and second curtain sections includes plural spaced hems, and wherein each of said rods is disposed within a respective one of said hems of a curtain section.

35. The roll-up curtain of claim 34 wherein each of said rods and hems extends the length of the curtain section within which the rod and hem combination is disposed.

36. The roll-up curtain of claim 35 further comprising plural connecting pins inserted through each of the lower portions of said first and second curtain sections and into said second and fourth lower rods.

37. The roll-up curtain of claim 36 wherein each of said connecting pins is a screw or nail.

38. The roll-up curtain of claim 31 wherein said first and second rotary drives further include first and second gearboxes respectively coupled to said first and second electric motors.

39. The roll-up curtain of claim 38 further comprising first and second double reduction drive assemblies respectively coupling said first and second gearboxes to said second and fourth lower rods.

40. The roll-up curtain of claim 39 wherein each of said first and second double reduction drive assemblies includes a respective drive sprocket coupled to a gearbox, a respective driven sprocket coupled to a lower rod, and a respective roller chain connecting paired drive and driven sprockets.

41. The roll-up curtain of claim 40 wherein said vertical guide includes a generally vertical panel disposed adjacent said rotary drives and first and second carriage members coupled to and movable with said first and second rotary drives, respectively, and engaging said vertical panel during vertical travel of said rotary drives.

42. The roll-up curtain of claim 41 wherein said vertical panel is generally flat and includes first and second opposed lateral edges each including a respective retaining flange, wherein said retaining flanges engage, prevent twisting and limit travel of said carriage members in a generally vertical direction.

43. The roll-up curtain of claim 42 wherein said retaining flanges are disposed along the length of said panel and are generally L-shaped in cross section and extend inwardly toward a flat inner portion of said panel.

44. The roll-up curtain of claim 43 wherein said carriage member is generally flat and elongated and is aligned with the flat inner portion of said panel.

45. The roll-up curtain of claim 44 wherein said carriage member includes first and second rollers each disposed on respective opposed ends of said carriage member, and wherein each of said rollers is disposed in and engaged by a respective retaining flange of said panel.

46. The roll-up curtain of claim 45 further comprising at least one elongated, linear shaft for rotationally mounting said rollers to said carriage member.

47. The roll-up curtain of claim 46 wherein the flat inner portion of said panel and said carriage member are aligned generally parallel with said second and fourth lower rods.

48. The roll-up curtain of claim 45 further comprising a third and fourth rollers respectively attached to said first and second carriage members intermediate the first and second ends thereof and engaging the flat inner portion of said panel for facilitating displacement of the rotary drives on said panel.

49. The roll-up curtain of claim 1 further comprising a first pair of detectors for sensing a full-up position and a full-down position of said first curtain section and a second pair of detectors for sensing a full-up position and a full-down position of said second curtain section for limiting vertical displacement of said first and second curtain sections.

50. The roll-up curtain of claim 49 wherein said first pair of detectors includes first upper and lower limit switches engaged by said second lower rod and said second pair of detectors includes second upper and lower limit switches engaged by said fourth lower rod.

51. The roll-up curtain of claim 49 wherein said second curtain section includes an upper portion and a lower portion and a fifth rod disposed on a lower edge of said lower portion, wherein said fourth lower rod is disposed intermediate said upper and lower portions and wherein said first pair of detectors includes first upper and lower limit switches engaged by said second lower rod and said second pair of detectors includes second upper and lower limit switches respectively engaged by said fourth lower rod and by said fifth rod.

* * * * *

UNITED STATES PATENT AND TRADEMARK OFFICE

CERTIFICATE OF CORRECTION

PATENT NO. : 7,152,653 B1
APPLICATION NO. : 10/821680
DATED : December 26, 2006
INVENTOR(S) : Larry J. Kubly and Richard P. Schmelzer It is certified that error appears in the above-identified patent and that said Letters Patent is hereby corrected as shown below:

Claim 41, Column 11, Line 23: Delete "40" and insert --31--

Signed and Sealed this

Twenty-seventh Day of March, 2007

JON W. DUDAS
*Director of the United States Patent and Trademark Office*